US009127696B2

(12) United States Patent
Kocurek et al.

(10) Patent No.: US 9,127,696 B2
(45) Date of Patent: Sep. 8, 2015

(54) SHAPE MEMORY ALLOY POWERED HYDRAULIC ACCUMULATOR

(75) Inventors: Chris Kocurek, Houston, TX (US); Gangbing Song, Houston, TX (US); David McWhorter, Magnolia, TX (US)

(73) Assignee: Cameron International Corporation, Houston, TX (US)

( * ) Notice: Subject to any disclaimer, the term of this patent is extended or adjusted under 35 U.S.C. 154(b) by 837 days.

(21) Appl. No.: 12/631,424

(22) Filed: Dec. 4, 2009

(65) Prior Publication Data

US 2011/0131964 A1 Jun. 9, 2011

(51) Int. Cl.

| | |
|---|---|
| ***F15B 15/14*** | (2006.01) |
| ***E21B 33/035*** | (2006.01) |
| ***F15B 15/08*** | (2006.01) |

(52) U.S. Cl.

CPC ..... *F15B 15/1476* (2013.01); *E21B 33/0355* (2013.01); *F15B 15/088* (2013.01)

(58) Field of Classification Search

CPC . E21B 33/0355; F15B 15/1476; F15B 15/088
USPC ..... 60/527–529
See application file for complete search history.

(56) References Cited

U.S. PATENT DOCUMENTS

| | | | | |
|---|---|---|---|---|
| 1,370,544 | A | 3/1921 | Leeper | |
| 3,058,185 | A | 10/1962 | Clayton et al. | |
| 3,625,002 | A | 12/1971 | Davis | |
| 4,806,815 | A | 2/1989 | Honma | |
| 4,811,564 | A * | 3/1989 | Palmer | 60/527 |
| 4,945,727 | A * | 8/1990 | Whitehead et al. | 60/527 |
| 5,079,920 | A | 1/1992 | Whitehead et al. | |
| 5,337,560 | A * | 8/1994 | Abdelmalek | 60/370 |
| 5,842,312 | A | 12/1998 | Krumme et al. | |
| 6,196,811 | B1 | 3/2001 | Hasse | |
| 6,247,678 | B1 | 6/2001 | Hines et al. | |
| 6,370,046 | B1 | 4/2002 | Nebrigic et al. | |
| 6,374,608 | B1 * | 4/2002 | Corris et al. | 60/528 |
| 6,447,478 | B1 | 9/2002 | Maynard | |
| 6,464,200 | B1 * | 10/2002 | Hines et al. | 251/11 |
| 6,574,958 | B1 | 6/2003 | MacGregor | |
| 6,832,478 | B2 | 12/2004 | Anderson et al. | |
| 7,070,577 | B1 | 7/2006 | Haller et al. | |
| 2004/0106894 | A1 * | 6/2004 | Hunter et al. | 604/66 |
| 2005/0200067 | A1 * | 9/2005 | Browne et al. | 269/289 R |

(Continued)

FOREIGN PATENT DOCUMENTS

| | | | |
|---|---|---|---|
| FR | 2718492 | 10/1995 | |
| FR | 2718492 A1 * | 10/1995 | F04B 9/00 |
| SU | 1102890 A1 | 7/1984 | |

OTHER PUBLICATIONS

English translation of FR 2718492 A1.*

(Continued)

*Primary Examiner* — Jason Shanske
(74) *Attorney, Agent, or Firm* — Fletcher Yoder, P.C.

(57) ABSTRACT

A system, in certain embodiments, includes an accumulator. The accumulator includes a first cylinder configured to receive a fluid within an internal volume of the first cylinder. The accumulator also includes a piston configured to move axially within the first cylinder. Axial movement of the piston within the first cylinder adjusts the internal volume of the first cylinder. The accumulator further includes a plurality of shape memory alloy wires configured to cause the axial movement of the piston within the first cylinder.

22 Claims, 4 Drawing Sheets

(56) References Cited

U.S. PATENT DOCUMENTS

| | | | | |
|---|---|---|---|---|
| 2007/0175642 | A1* | 8/2007 | Shampine et al. | 166/382 |
| 2008/0226421 | A1* | 9/2008 | Rudduck et al. | 411/356 |
| 2008/0245432 | A1* | 10/2008 | Lenz | 138/30 |
| 2009/0139727 | A1 | 6/2009 | Tanju et al. | |
| 2009/0159273 | A1* | 6/2009 | Guerrero | 166/250.01 |
| 2009/0159295 | A1* | 6/2009 | Guerrero et al. | 166/382 |
| 2011/0131964 | A1 | 6/2011 | Kocurek et al. | |

OTHER PUBLICATIONS

U.S. Appl. No. 12/841,995, filed Jul. 22, 2010, Garrett Lewis, et al.
U.S. Appl. No. 12/841,998, filed Jul. 22, 2010, Garrett Lewis, et al.
U.S. Appl. No. 12/842,003, filed Jul. 22, 2010, Garrett Lewis, et al.
U.S. Appl. No. 12/842,008, filed Jul. 22, 2010, Garrett Lewis, et al.
Ning Ma, U. et al.; "Design and Performance Evaluation of an Ultradeepwater Subsea Blowout Preventer Control System Using Shape Memory Alloy Actuators;" SPE Annual Technical Conference and Exhibition; XP003023864, Sep. 24, 2006; pp. 1-8.
Ning Ma U. et al.; "Design and Performance Evaluation of an Ultradeepwater Subsea Blowout Preventor Control System Using Shape Memory Alloy Actuators"; SPE Annual Technical Conference and Exhibition; Sep. 24, 2006; pp. 1-8.
PCT International Preliminary Report and Written Opinion for PCT/US2010/049171, mailed on Jun. 14, 2012.
PCT Search Report and Written Opinion for PCT/US2011/034361, mailed on Sep. 5, 2011.
PCT Search Report and Written Opinion for PCT/US2011/034340, mailed on Sep. 30, 2011.
PCT Search Report and Written Opinion for PCT/US2011/034385, mailed on Sep. 5, 2011.
PCT Search Report and Written Opinion for PCT/US2011/034375, mailed on Sep. 2, 2011.

* cited by examiner

SHAPE MEMORY ALLOY POWERED HYDRAULIC ACCUMULATOR

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Deepwater accumulators provide a supply of pressurized working fluid for the control and operation of sub-sea equipment, such as through hydraulic actuators and motors. Typical sub-sea equipment may include, but is not limited to, blowout preventers (BOPs) that shut off the well bore to protect an oil or gas well from accidental discharges to the environment, gate valves for flow control of oil or gas to the surface or to other sub-sea locations, electro-hydraulic control pods, or hydraulically-actuated connectors and similar devices.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
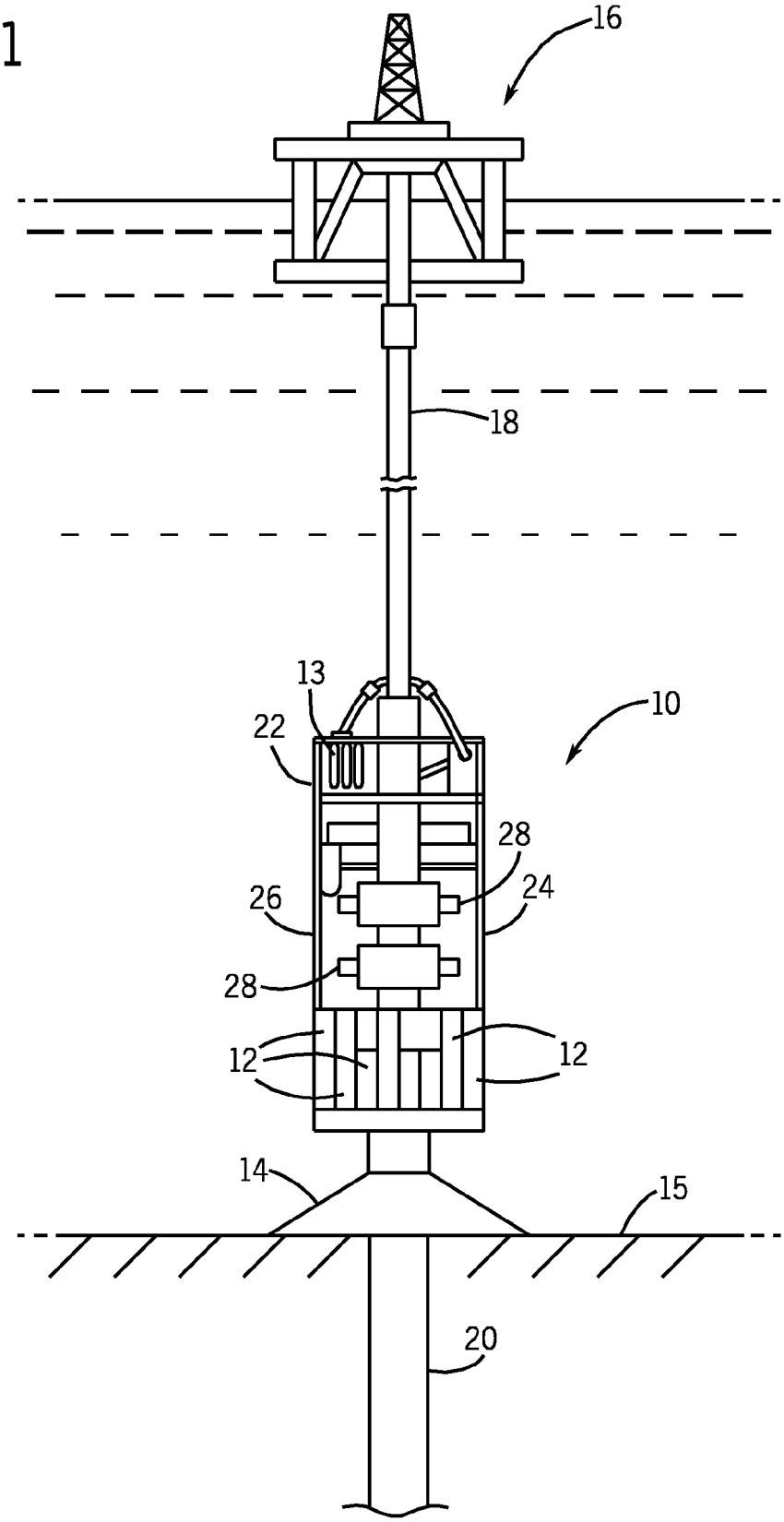
FIG. 1 is a sub-sea BOP stack assembly, which may include one or more shape memory alloy (SMA)-powered hydraulic accumulators.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Accumulators may be divided into a gas section and a hydraulic fluid section that operate on a common principle. The general principle is to pre-charge the gas section with pressurized gas to a pressure at or slightly below the anticipated minimum pressure to operate the sub-sea equipment. Fluid can be added to the accumulator in the separate hydraulic fluid section, compressing the gas section, thus increasing the pressure of the pressurized gas and the hydraulic fluid together. The hydraulic fluid introduced into the accumulator is therefore stored at a pressure equivalent to the pre-charge pressure and is available for doing hydraulic work. However, gas-charged accumulators used in sub-sea environments may undergo a decrease in efficiency as water depth increases. This loss of efficiency is due, at least in part, to an increase of hydrostatic stress acting on the pre-charged gas section, which provides the power to the accumulators through the compressibility of the gas.

The pre-charge gas can be said to act as a spring that is compressed when the gas section is at its lowest volume and greatest pressure and released when the gas section is at its greatest volume and lowest pressure. Accumulators may be pre-charged in the absence of hydrostatic pressure and the pre-charge pressure may be limited by the pressure containment and structural design limits of the accumulator vessel under surface ambient conditions. Yet, as described above, as accumulators are used in deeper water, their efficiency decreases as application of hydrostatic pressure causes the gas to compress, leaving a progressively smaller volume of gas to charge the hydraulic fluid. The gas section must consequently be designed such that the gas still provides enough power to operate the sub-sea equipment under hydrostatic pressure even as the hydraulic fluid approaches discharge and the gas section is at its greatest volume and lowest pressure.

For example, accumulators at the surface may provide 3,000 psi (pounds per square inch) maximum working fluid pressure. In 1,000 feet of seawater, the ambient pressure is approximately 465 psi. Therefore, for an accumulator to provide a 3,000 psi differential at the 1,000 foot depth, it must actually be pre-charged to 3,000 psi plus 465 psi, or 3,465 psi. At slightly over 4,000 feet water depth, the ambient pressure is almost 2,000 psi. Therefore, the pre-charge would be required to be 3,000 psi plus 2,000 psi, or 5,000 psi. In others words, the pre-charge would equal the working pressure of the accumulator. Any fluid introduced for storage may cause the pressure to exceed the working pressure and may lead to accumulator failure. Thus, at progressively greater hydrostatic operating pressures, the accumulator has greater pressure containment requirements at non-operational (e.g., no ambient hydrostatic pressure) conditions.

Given the limited structural capacity of the accumulator to safely contain the gas pre-charge, operators of this type of equipment may be forced to work within efficiency limits of the systems. For example, when deep water systems are required to utilize hydraulic accumulators, operators will often add additional accumulators to the system. Some accumulators may be charged to 500 psi, 2,000 psi, 5,000 psi, or higher, based on system requirements. As the equipment is initially deployed in the water, all accumulators may operate normally. However, as the equipment is deployed in deeper water (e.g., past 1,000 feet), the accumulators with the 500 psi pre-charge may become inefficient due to the hydrostatic compression of the gas charge. Additionally, the hydrostatic pressure may act on all the other accumulators, decreasing their efficiency. The decrease in efficiency of the sub-sea gas charged accumulators decreases the amount and rate of work which may be performed at deeper water depths. As such, for sub-sea equipment designed to work beyond 5,000 foot water depth, the amount of gas charged accumulators must be increased by 5 to 10 times. The addition of these accumulators increases the size, weight, and complexity of the sub-sea equipment, in addition to generating hundreds of potential additional failure points, all of which increases the cost and potential risk of equipment failure.

Conversely, the disclosed embodiments do not rely on gas to provide power for the accumulator. Rather, shape memory alloy (SMA) wires acting in tension on a piston provide the power. In addition, the back side of the piston may be balanced with the hydrostatic pressure at any water depth. This may be achieved through the use of a "sea chest," which is a rubber bladder which transfers hydrostatic pressure (from the water depth) to a fluid (e.g., the dielectric fluid on the back side of the SMA accumulator piston) on the other side. This means that the SMA material need only generate a reduced amount of power (compared to non-balanced accumulators) since it does not need to overcome the hydrostatic pressure load and no loss of efficiency is experienced due to water depth. Additionally, the SMA-powered hydraulic accumulator is not limited to constant pressure output since the actuation current of the SMA materials may be adjusted. Furthermore, the power output of the SMA materials may be adjusted without the need for pumps or valves. This may allow for the adjustment of output pressure from the accumulator, further increasing the flexibility of the equipment. In addition, leak paths may be substantially reduced using the disclosed embodiments.

The SMA-powered hydraulic accumulator may be used in various types of equipment. For instance, FIG. 1 depicts a sub-sea BOP stack assembly 10, which may include one or more large SMA-powered hydraulic accumulators 12 and/or one or more small SMA-powered hydraulic accumulators 13. The small SMA-powered hydraulic accumulators 13 may function similarly to the large SMA-powered hydraulic accumulators described herein, except that the small SMA-powered hydraulic accumulators 13 may be used for smaller sizes and capacities than the large SMA-powered hydraulic accumulators 12. As illustrated, the BOP stack assembly 10 may be assembled onto a wellhead assembly 14 on the sea floor 15. The BOP stack assembly 10 may be connected in line between the wellhead assembly 14 and a floating rig 16 through a sub-sea riser 18. The BOP stack assembly 10 may provide emergency fluid pressure containment in the event that a sudden pressure surge escapes the well bore 20. Therefore, the BOP stack assembly 10 may be configured to prevent damage to the floating rig 16 and the sub-sea riser 18 from fluid pressure exceeding design capacities. The BOP stack assembly 10 may also include a BOP lower riser package 22, which may connect the sub-sea riser 18 to a BOP package 24.

In certain embodiments, the BOP package 24 may include a frame 26, BOPs 28, and SMA-powered hydraulic accumulators 12, which may be used to provide backup hydraulic fluid pressure for actuating the BOPs 28. The SMA-powered hydraulic accumulators 12 may be incorporated into the BOP package 24 to maximize the available space and leave maintenance routes clear for working on components of the sub-sea BOP package 24. The SMA-powered hydraulic accumulators 12 may be installed in parallel where the failure of any single SMA-powered hydraulic accumulator 12 may prevent the additional SMA-powered hydraulic accumulators 12 from functioning.

In general, SMAs are materials which have the ability to return to a predetermined shape when heated. More specifically, when SMAs are below their transformation temperature, they have relatively low yield strengths and may be deformed into and retain any new shape relatively easy. However, when SMAs are heated above their transformation temperature, they undergo a change in crystal structure, which causes them to return to their original shape with much greater force than from their low-temperature state. During phase transformations, SMAs may either generate a relatively large force against any encountered resistance or undergo a significant dimension change when unrestricted. This shape memory characteristic may provide a unique mechanism for remote actuation.

One particular shape memory material is an alloy of nickel and titanium called Nitinol. This particular alloy is characterized by, among other things, long fatigue life and high corrosion resistance. Therefore, it may be particular useful as an actuation mechanism within the harsh operating conditions encountered with sub-sea mineral extraction applications. As an actuator, it is capable of up to approximately 5% strain recovery or approximately 500 MPa restoration stress with many cycles, depending upon the material composition. For example, a Nitinol wire 0.5 mm in diameter may generate as much as approximately 15 pounds of force. Nitinol also has resistance properties which enable it to be actuated electrically by heating. In other words, when an electric current is passed directly through a Nitinol wire, it can generate enough heat to cause the phase transformation. In addition, other methods of heating the SMA wire may be utilized. Although Nitinol is one example of an SMA which may be used in the SMA-powered hydraulic accumulators 12 of the disclosed embodiments, any SMAs with suitable transition temperatures and other properties may also be used. In many cases, the transition temperature of the SMA may be chosen such that surrounding temperatures in the operating environment are well below the transformation point of the material. As such, the SMA may be actuated only with the intentional addition of heat.

The unique properties of SMAs make them a potentially viable choice for actuators. For example, when compared to piezoelectric actuators, SMA actuators may offer an advantage of being able to generate larger deformations and forces at much lower operating frequencies. In addition, SMAs may be fabricated into different shapes, such as wires and thin films. In particular, SMA wires with diameters less then 0.75 mm may be used to form stranded cables for use in the SMA-powered hydraulic accumulators 12. Accordingly, SMA-powered actuators such as the SMA-powered hydraulic accumulators 12 described herein may be used in myriad applications. For example, the SMA wires described below may be used in SMA-powered actuators such as hydraulic actuators, pneumatic actuators, mechanical actuators, and so forth. However, as described herein, the use of SMA wires may provide particular benefits in the realm of sub-sea equipment, such as the SMA-powered hydraulic accumulators 12 described in FIG. 1.

Figure 2:
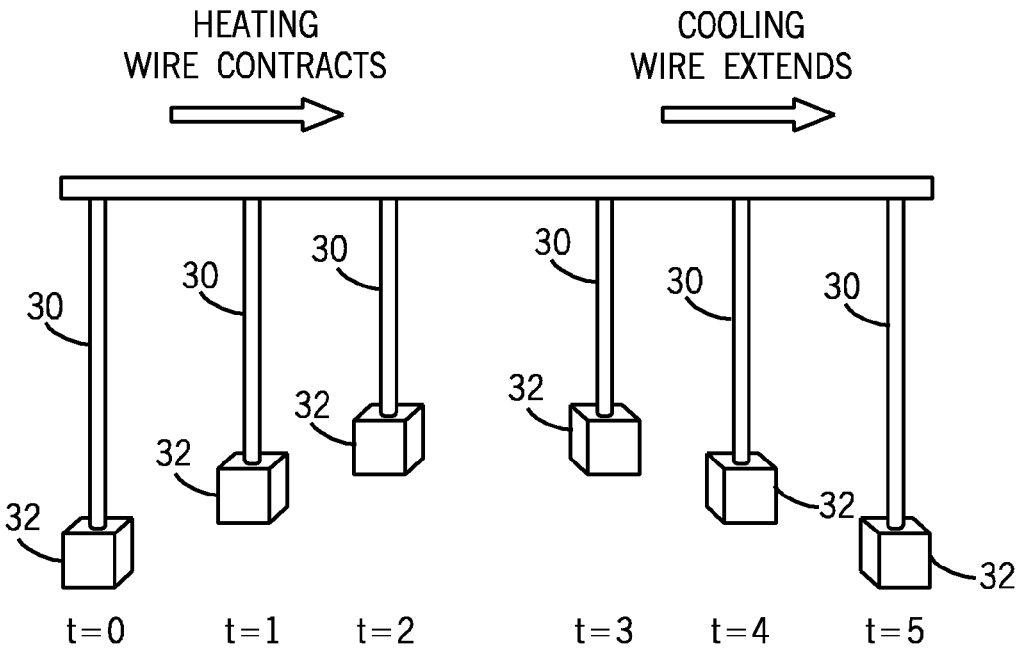
FIG. 2 is an exemplary SMA wire being used to lift a weight.

FIG. 2 depicts an exemplary SMA wire 30 being used to lift a weight 32. In particular, moving from left to right, FIG. 2 illustrates a time series whereby an electrical current may be introduced through the SMA wire 30 to gradually heat the SMA wire 30 and then gradually cool the SMA wire 30. In particular, at initial time $t_0$, no electrical current flows through the SMA wire 30. At time $t_0$, the SMA wire 30 may be at a temperature below the transition temperature of the SMA wire 30. As such, the SMA wire 30 may have been extended to a deformed shape by the force applied to the SMA wire 30 by the weight 32. Once electrical current is applied to the SMA wire 30, the temperature of the SMA wire 30 may gradually increase such that the transition temperature of the SMA wire 30 may be exceeded. When this occurs, the SMA wire 30 may begin returning to its predetermined shape such that the force applied by the weight 32 may be overcome, resulting in the SMA wire 30 lifting the weight 32, as shown at time $t_1$. At some point, such as time $t_2$, the force applied by the weight 32 may be entirely overcome such that the SMA wire 30 returns to its predetermined shape. Therefore, from time $t_0$ to time $t_2$, the SMA wire 30 may be heated and, as a result, may contract and overcome the force of the weight 32. As described above, as the temperature of the SMA wire 30 increases through the transition temperature, the SMA wire 30 may either generate a relatively large force against any encountered resistance (e.g., against the force of the weight 32), undergo a significant dimension change when unrestricted (e.g. lifting the weight 32), or generate some force and undergo some dimension change at the same time (e.g., lifting the weight 32 to some distance below its predetermined state).

Conversely, at time $t_3$, the electrical current may cease flowing through the SMA wire 30. Once the electrical current ceases flowing through the SMA wire 30, the temperature of the SMA wire 30 may gradually decrease to below the transition temperature of the SMA wire 30. When this occurs, the force of the weight 32 may begin deforming the SMA wire 30, as shown at time $t_4$. At some point, such as time $t_5$, the force applied by the weight 32 may entirely overcome the SMA wire 30, extending it to the deformed shape from time $t_0$. Therefore, from time $t_3$ to time $t_5$, the SMA wire 30 may be cooled and, as a result, may extend due to the force of the weight 32. As the temperature of the SMA wire 30 decreases through the transition temperature, the SMA wire 30 may undergo a significant dimension change when unrestricted (e.g. in allowing the weight 32 to fall).

Figure 3:
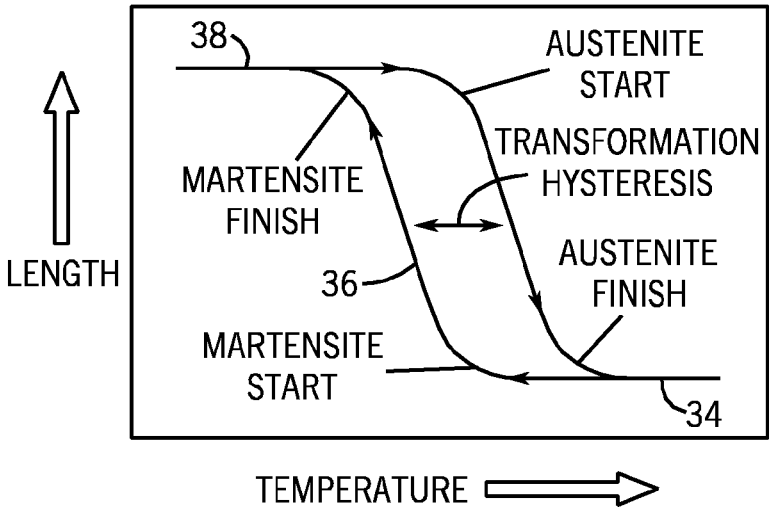
FIG. 3 is an SMA transitioning from the Austenite phase to the Martensite phase and back.

The unique properties of SMAs result from the reversible phase transformation between their crystal structures, for instance, the stronger high temperature Austenite phase and the weaker low temperature Martensite phase. FIG. 3 depicts an SMA transitioning from the Austenite phase to the Martensite phase and back. When cooling from its high temperature Austenite phase 34, the SMA undergoes a transformation to a twinned Martensite phase 36. The twinned Martensite phase 36 may be easily deformed by an external force. This process is often called de-twinning. The Martensite phase 38 is then reversed when the de-twinned structure reverts upon heating to the Austenite phase 34. The unique ability of a reversible crystalline phase transformation enables an SMA object either to recover its initial heat-treated shape (up to approximately 5% strain) when heated above a critical transition temperature or alternatively to generate high recovery stresses (in excess of 500 MPa). As shown in FIG. 3, the transformation exhibits a hysteretic effect, in that the transformations on heating and on cooling do not overlap. This hysteretic effect may be taken into account by a feedback control system with appropriate hysteresis compensation to achieve higher precision in either a position control or a force control system.

Figure 4:
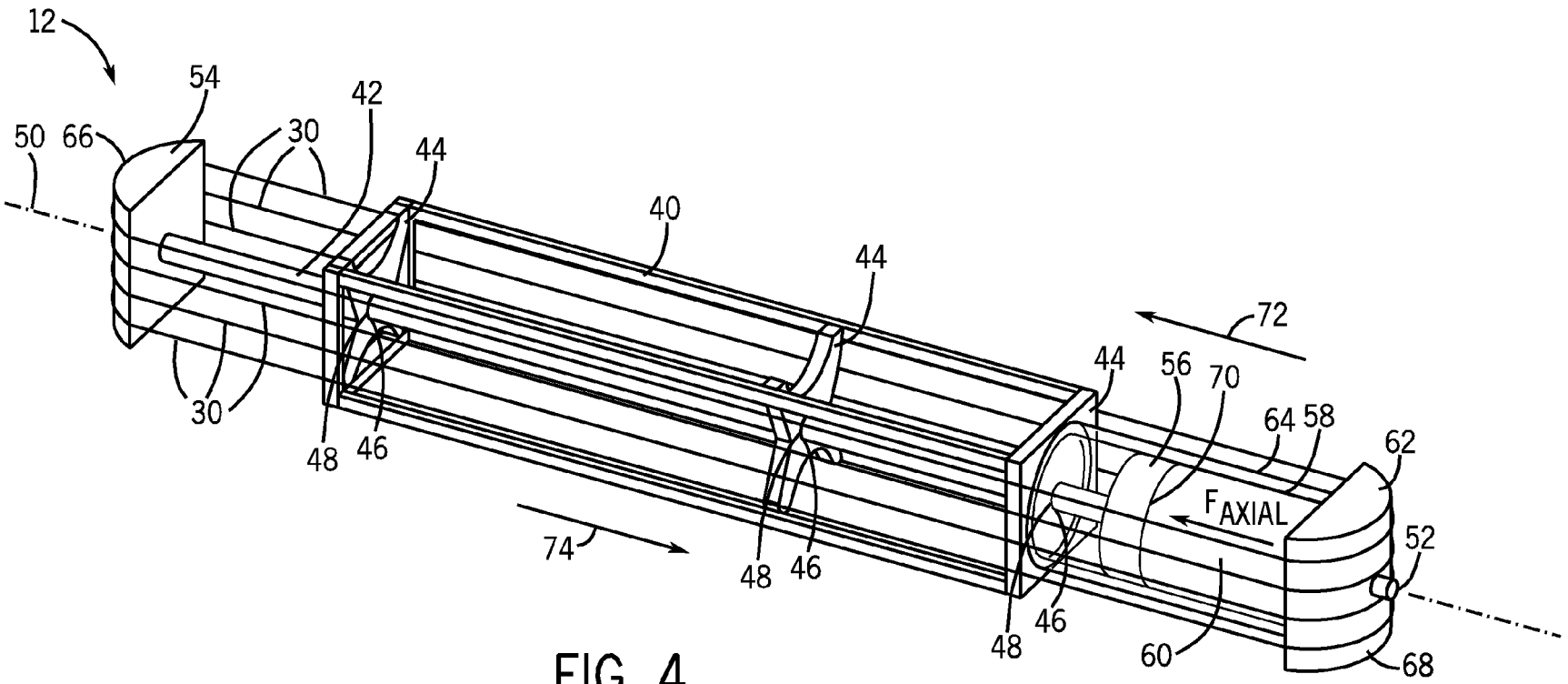
FIG. 4 is an exemplary embodiment of an SMA-powered hydraulic accumulator.

FIG. 4 depicts an exemplary embodiment of an SMA-powered hydraulic accumulator 12. As illustrated, the SMA-powered hydraulic accumulator 12 may include a frame 40 through which a rod 42 may extend. At least one frame support 44 may support the rod 42 within the frame 40. In particular, the rod 42 may pass through apertures 46 in each of the frame supports 44. More specifically, linear bearings 48 may support the rod 42 within the frame supports 44. As such, the linear bearings 48 may enable axial movement along a longitudinal axis 50 of the SMA-powered hydraulic accumulator 12.

In the present context, the term "proximal" generally refers to ends of components of the SMA-powered hydraulic accumulator 12 which are closer to a fluid inlet/outlet 52 of the SMA-powered hydraulic accumulator 12. Conversely, the term "distal" generally refers to ends of components of the SMA-powered hydraulic accumulator 12 which are farther away from the fluid inlet/outlet 52 of the SMA-powered hydraulic accumulator 12.

The rod 42 may be connected at a distal end to a first end cap 54 and at a proximal end to a piston 56. The piston 56 may fit inside and mate with an inner cylinder 58, forming a hydraulic seal within which fluid 60 may be accumulated. In addition, the piston 56 may be configured to move axially within the inner cylinder 58 when the rod 42 moves axially in the same direction, thereby adjusting the interior volume of the inner cylinder 58 within which the fluid 60 accumulates. The inner cylinder 58 may be connected at a distal end to a proximal frame support 44 and at a proximal end to a second end cap 62. The fluid 60 may enter and exit a proximal section of the inner cylinder 58 via the fluid inlet/outlet 52. In addition, in certain embodiments, the inner cylinder 58 may be radially surrounded by an outer cylinder 64 which may isolate the inner cylinder 58 from harsh external environmental conditions.

In certain embodiments, SMA wires 30 may be wrapped around the first and second end caps 54, 62 as illustrated in FIG. 4. For instance, the SMA wires 30 may form a plurality of continuous lengths of stranded or braided cables which extend from the first end cap 54 to the second end cap 62, wrap around the second end cap 62, extend from the second end cap 62 to the first end cap 54, and wrap around the first end cap 54. As such, the SMA wires 30 may generally be located on opposite sides of the SMA-powered hydraulic accumulator 12. However, in other embodiments, the SMA wires 30 may be located on all sides of the SMA-powered hydraulic accumulator 12. Indeed, in certain embodiments, instead of using SMA wires 30 as illustrated in FIG. 4, the SMA-powered hydraulic accumulator 12 may utilize thin films of SMA material, which may stretch from the first end cap 54 to the second end cap 62. Moreover, other arrangements of SMA material may be utilized.

In certain embodiments, the manner in which the SMA wires 30 are wrapped around the first and second end caps 54, 62 may be facilitated by the shape of the first and second end caps 54, 62, as shown in FIG. 4. More specifically, the cross-section of the first and second end caps 54, 62 may be semi-circular in nature, as shown. In addition, in certain embodiments, grooves may be extruded in the externally-facing surfaces 66, 68 of the first and second end caps 54, 62, respectively, within which the SMA wires 30 may be secured. In addition, in certain embodiments, the SMA wires 30 and/or grooves may be coated with a suitable electrically non-conductive material for electrical isolation of the SMA wires 30 from the rest of the system (e.g., for safety of the operators and other systems). Furthermore, in certain embodiments, other suitable fasteners may be used to secure the SMA wires 30 to the externally-facing surfaces 66, 68 of the first and second end caps 54, 62, respectively.

The SMA-powered hydraulic accumulator 12 may be designed such that normal operating temperatures are substantially below the transition temperature of the SMA wires 30. As such, the SMA wires 30 may normally be allowed to deform when subjected to particular forces. In particular, the fluid 60 within the inner cylinder 58 may be pressurized (e.g., by hydraulic and hydrostatic pressures). The pressure in the fluid 60 may exert axial forces $F_{axial}$ on a proximal face 70 of the piston 56 along the longitudinal axis 50. These axial forces $F_{axial}$ may urge the piston 56 to move distally along the longitudinal axis 50, as illustrated by arrow 72, allowing more fluid 60 to enter the inner cylinder 58. This axial movement of the piston 56 may force the rod 42 and the first end cap 54 to move distally along the longitudinal axis 50 as well. However, the second end cap 62 may generally remain in a fixed position. Therefore, under normal operating temperatures, the SMA wires 30 which are wrapped around the first and second end caps 54, 62 of the SMA-powered hydraulic accumulator 12 may be stretched as a result of the hydraulic and/or hydrostatic pressures of the fluid 60 within the inner cylinder 58. In particular, this stretching of the SMA wires 30 may generally occur axially along the longitudinal axis 50, as again illustrated by arrow 72.

However, once an electrical current begins flowing through the SMA wires 30, the temperature within the SMA wires 30 may begin to increase. At some point, the temperature may exceed the transition temperature for the SMA material used in the SMA wires 30. Once the transition temperature of the SMA wires 30 is exceeded, the SMA wires 30 may begin to contract toward their predetermined shape. The contraction of the SMA wires 30 may force the first and second end caps 54, 62 to move together axially along the longitudinal axis 50. More specifically, the second end cap 62 may again generally remain in its fixed position while the first end cap 54 may move axially toward the second end cap 62 (i.e., toward the proximal end of the SMA-powered hydraulic accumulator 12), as illustrated by arrow 74. As the first end cap 54 moves axially closer to the proximal end of the SMA-powered hydraulic accumulator 12, the rod 42 may also move in the same direction axially and may begin to force the piston 56 in the same axial direction as well. As such, the piston 56 may begin to counteract the axial forces $F_{axial}$ exerted by the pressure of the fluid 60 within the inner cylinder 58. As such, the piston 56 may begin displacing the fluid 60 within the inner cylinder 58, causing the fluid 60 to exit through the fluid inlet/outlet 52.

At some point, the SMA wires 30 may be restored to their predetermined shape and further heating via electrical current may no longer cause the SMA wires 30 to further contract. In certain embodiments, the SMA-powered hydraulic accumulator 12 may be designed such that the predetermined shape of the SMA wires 30 corresponds to a location of the piston 56 within the inner cylinder 58 which may cause substantially all of the volume of the fluid 60 to be evacuated from the inner cylinder 58. Likewise, in certain embodiments, the SMA-powered hydraulic accumulator 12 may be designed such that the maximum deformation shape for the SMA wires 30 corresponds to a location of the piston 56 within the inner cylinder 58 which may cause substantially all of the volume of the inner cylinder 58 to be filled with the liquid 60. However, in other embodiments, the predetermined shape and maximum deformation shape of the SMA wires 30 may correspond to other locations of the piston 56 within the inner cylinder 58.

In addition, in certain embodiments, the SMA-powered hydraulic accumulator 12 may be designed slightly differently. For example, in certain embodiments, the SMA-powered hydraulic accumulator 12 may not include a rod 42 connected between the first end cap 54 and the piston 56. Rather, in this embodiment, the first end cap 54 may instead be connected directly to the piston 56, which may extend distally from the inner cylinder 58 by a certain amount to allow for expansion and contraction of the SMA wires 30. Indeed, in certain embodiments, the SMA-powered hydraulic accumulator 12 may not include a first end cap 54. Rather, the SMA wires 30 may be wrapped directly around the piston 56.

The amount of volume of fluid 60 that the SMA-powered hydraulic accumulator 12 may be capable of displacing may vary based on the particular size of the SMA-powered hydraulic accumulator 12, the type of fluid 60 used, the pressure of the fluid 60, the type of SMA material used for the SMA wires 30, and so forth. In addition, although described herein as including a plurality of SMA wires, the SMA-powered hydraulic accumulator 12 may actually incorporate other designs for the SMA materials which provide the actuation power. For instance, in certain embodiments, the SMA materials may be in the shape of continuous, thin films which may wrap around the first and second end caps 54, 62 of the SMA-powered hydraulic accumulator 12.

As described above, the SMA-powered hydraulic accumulator 12 may be used in several different sub-sea applications, such as BOPS, gate valves, or hydraulically-actuated and similar devices. For example, as illustrated in FIG. 1, the BOP stack assembly 10 may include a plurality of SMA-powered hydraulic accumulators 12 working in parallel. The SMA-powered hydraulic accumulators 12 described herein may generally operate at lower frequencies than conventional hydraulic accumulators. However, since the SMA-powered hydraulic accumulators 12 act in tension on the piston 56 to provide power, do not need to overcome the hydrostatic pressure load, and do not experience efficiency loss due to water depth, the SMA-powered hydraulic accumulators 12 are generally more efficient than conventional hydraulic accumulators.

Figure 5:
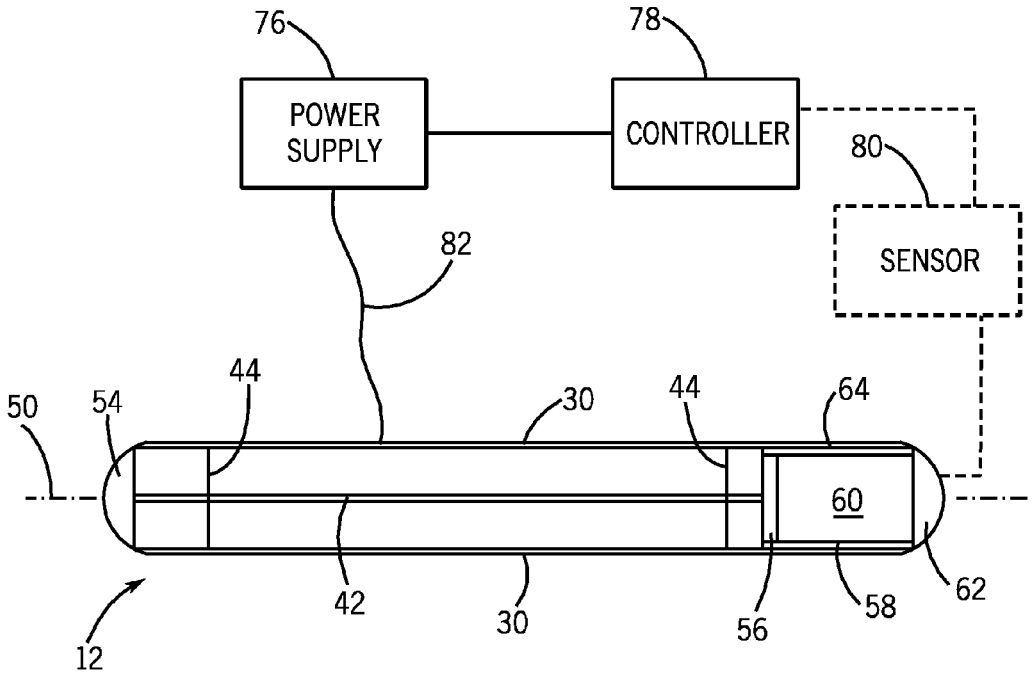
FIG. 5 is an exemplary embodiment of the SMA-powered hydraulic accumulator of FIG. 4 with an associated power supply, controller, and sensor.

FIG. 5 is an exemplary embodiment of the SMA-powered hydraulic accumulator 12 of FIG. 4 with an associated power supply 76, controller 78, and sensor 80, which may be a single or group of pressure and/or displacement and/or force sensors. As illustrated, in certain embodiments, the SMA wires 30 of the SMA-powered hydraulic accumulator 12 may be heated with current from the power supply 76 via actuation wires 82. The power supply 76 may either be an alternating current (AC) or direct current (DC) power supply. In general, the use of AC power may be the easier and least expensive option (e.g., using a transformer). However, the use of DC power may be the more self-sustainable option (e.g., a battery and amplifier) given the remote nature of most sub-sea applications.

In certain embodiments, the supply of current to the SMA wires 30 via the actuation wires 82 may be controlled by the controller 78. In certain embodiments, the controller 78 may include a memory device and a machine-readable medium with instructions encoded thereon for determining how much (if any) current should be supplied from the power supply 76 to the SMA wires 30 of the SMA-powered hydraulic accumulator 12. In certain embodiments, the controller 78 may be configured to receive feedback from the sensor 80 attached to the SMA-powered hydraulic accumulator 12 and/or the application (e.g., the BOP stack assembly 10 of FIG. 1) within which the SMA-powered hydraulic accumulator 12 is being used to determine whether, and how much, current should be supplied to the SMA wires 30 via the actuation wires 82. For example, in certain embodiments, the controller 78 may be configured to receive sensor measurements (e.g., pressure measurements, temperature measurements, flow rate measurements, displacement measurements, and so forth) from the SMA-powered hydraulic accumulator 12 and/or the application within which the SMA-powered hydraulic accumulator 12 is being used. The controller 78 may use the sensor measurements to vary the amount of current supplied to the SMA wires 30. In certain embodiments, the controller 78 may contain specific code for determining a relationship between the current supplied to the SMA wires 30, the temperature of the SMA wires 30, the amount of deformation of the SMA wires 30 corresponding to changes in temperature, and so forth. For example, as described above, the amount of deformation of the SMA wires 30 may depend on the transition temperature of the SMA material used for the SMA wires 30.

Since the controller 78 may be capable of adjusting the current supplied to the SMA wires 30, the SMA-powered hydraulic accumulator 12 is not limited to constant pressure output. Furthermore, the power output of the SMA-powered hydraulic accumulator 12 may be adjusted without the need for pumps or valves, further increasing the flexibility of the SMA-powered hydraulic accumulator 12, among other things.

Figure 6:
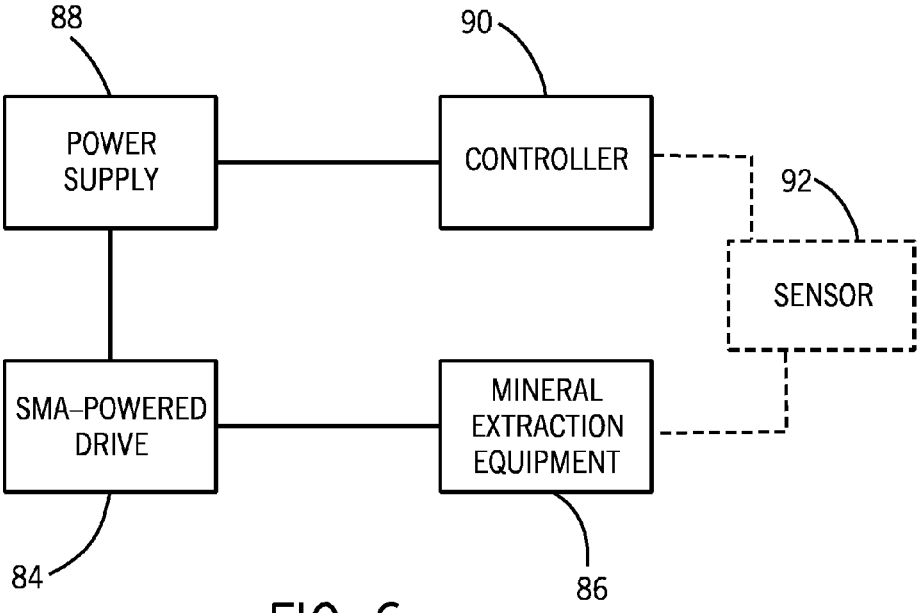
FIG. 6 is an exemplary embodiment of an SMA-powered drive which may be used to drive a mineral extraction component.

Moreover, the disclosed embodiments may be extended to include other type of SMA-powered drives configured to drive various mineral extraction components. For example, FIG. 6 is an exemplary embodiment of an SMA-powered drive 84 which may be used to drive a mineral extraction component 86. A power supply 88, similar to the power supply 76 illustrated in FIG. 5, may be coupled to the SMA-powered drive 84 and a controller 90, similar to the controller 78 illustrated in FIG. 5, may be configured to adjust the power of the SMA-powered drive 84 to control a force generated by the SMA-powered drive 84 and sensor 92, similar to sensor 80 in FIG. 5, may be coupled to the mineral extraction component 86 or in between the mineral extraction component 86 and the SMA-powered drive 84. As described above, the force generated by the SMA-powered drive 84 may be cyclical based on the application of current from the power supply 88 to the SMA-powered drive 84. In general, the SMA-powered drive 84 may operate at somewhat lower frequencies but, depending on the particular design, may be capable of generating high forces. For example, in certain embodiments, the mineral extraction component 86 may be a fluid pump configured to be driven by the SMA-powered drive 84. Other types of mineral extraction components 86 which may be driven by the SMA-powered drive 84 may include, but are not limited to, pumps, compressors, valves, accumulators, and so forth. In addition, other types of equipment, other than mineral extraction equipment, may also be driven by the SMA-powered drive 84 using the disclosed techniques.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

an accumulator configured to store hydraulic fluid to operate subsea equipment, wherein the accumulator comprises:

a first cylinder configured to receive a fluid within an internal volume of the first cylinder;

a piston configured to move axially within the first cylinder, wherein axial movement of the piston within the first cylinder adjusts the internal volume of the first cylinder;

a rod extending axially from the piston;

a first end cap disposed at a first axial end of the accumulator, wherein the first end cap is connected to the rod;

a second end cap disposed at a second axial end of the accumulator, wherein the second end cap is connected to the first cylinder;

a plurality of shape memory alloy wires extending from the first end cap to the second end cap, wherein the plurality of shape memory alloy wires are configured to cause the axial movement of the piston within the first cylinder; and a controller configured to adjust an amount of electrical current through the plurality of shape memory alloy wires based at least in part on a measurement sensed by a sensor.

2. The system of claim 1, wherein the second end cap comprises an opening through which the fluid enters and exits the internal volume of the first cylinder.

3. The system of claim 1, comprising a power supply configured to supply an electrical current through the plurality of shape memory alloy wires.

4. The system of claim 1, wherein the accumulator comprises a second cylinder which radially surrounds the first cylinder.

5. The system of claim 1, comprising a blowout preventer stack assembly having the accumulator.

6. The system of claim 1, wherein the plurality of shape memory alloy wires are made of a material comprising Nitinol or other types of shape memory alloys.

7. The system of claim 1, wherein the plurality of shape memory alloy wires are disposed external to the first cylinder.

8. The system of claim 1, wherein the accumulator comprises a frame between the first cylinder and the first end cap.

9. A system, comprising:

an accumulator configured to store hydraulic fluid to operate subsea equipment, wherein the accumulator comprises a piston disposed within a cylinder, a frame coupled to the cylinder, a rod extending from the piston and completely through the frame, a first end cap connected to the rod and disposed at a first axial end of the accumulator, and a second end cap connected to the cylinder and disposed at a second axial end of the accumulator; wherein the piston is configured to be axially moved within the cylinder by a shape memory alloy extending from the first end cap to the second end cap.

10. The system of claim 9, wherein the shape memory alloy comprises a plurality of shape memory alloy wires configured to cause axial movement of the piston within the cylinder.

11. The system of claim 9, wherein the shape memory alloy comprises a film of shape memory alloy configured to cause axial movement of the piston within the cylinder.

12. The system of claim 9, comprising a power supply configured to supply an electrical current through the shape memory alloy.

13. The system of claim 12, comprising a controller configured to adjust the supply of electrical current through the shape memory alloy.

14. The system of claim 9, wherein the shape memory alloy is made of a material comprising Nitinol or other types of shape memory alloys.

15. The system of claim 9, wherein the shape memory alloy is disposed external to the cylinder.

16. The system of claim 12, comprising a sensor coupled to a controller, wherein the controller is configured to use a measurement from the sensor to adjust the supply of electrical current through the shape memory alloy.

17. The system of claim 9, wherein the frame comprises at least one linear bearing.

18. The system of claim 9, wherein the cylinder couples to an end of the frame.

19. A method for actuating an accumulator configured to store hydraulic fluid to operate subsea equipment, comprising:

supplying an electrical current through a plurality of shape memory alloy wires extending from a first end cap disposed at a first axial end of the accumulator to a second end cap disposed at a second axial end of the accumulator to cause axial movement of an accumulator piston within an accumulator cylinder; and adjusting an amount of the electrical current with a controller based at least in part on a measurement sensed by a sensor.

20. The method of claim 19, wherein supplying the electrical current through the plurality of shape memory alloy wires comprises increasing the temperature of the plurality of shape memory alloy wires above a transition temperature of the plurality of shape memory alloy wires, wherein the transition temperature of the plurality of shape memory alloy wires is the temperature at which the plurality of shape memory alloy wires transit from a Martensite phase to an Austenite phase.

21. The method of claim 19, wherein the plurality of shape memory alloy wires are disposed external to the accumulator cylinder.

22. The system of claim 19, wherein the sensor comprises a pressure sensor, a temperature sensor, a flow rate sensor, or a displacement sensor.

* * * * *